US008043239B2

(12) United States Patent
Rastegar et al.

(10) Patent No.: US 8,043,239 B2
(45) **Date of Patent: *Oct. 25, 2011**

(54) EXTERNAL COUNTERPULSATION (ECP) DEVICE FOR USE IN AN AMBULANCE OR THE LIKE FOR HEART ATTACK PATIENTS TO LIMIT HEART MUSCLE DAMAGE

(75) Inventors: Jahangir Rastegar, Stony Brook, NY (US); Harry Soroff, Northport, NY (US)

(73) Assignee: PPTT, LLC, Northport, NY (US)

( * ) Notice: Subject to any disclaimer, the term of this patent is extended or adjusted under 35 U.S.C. 154(b) by 446 days.

This patent is subject to a terminal disclaimer.

(21) Appl. No.: 11/805,550

(22) Filed: May 23, 2007

(65) Prior Publication Data

US 2008/0033228 A1 Feb. 7, 2008

Related U.S. Application Data

(63) Continuation-in-part of application No. 11/009,222, filed on Dec. 10, 2004, now abandoned, which is a continuation of application No. 09/851,930, filed on May 10, 2001, now Pat. No. 6,846,294.

(60) Provisional application No. 60/808,450, filed on May 25, 2006.

(51) Int. Cl.
*A61H 9/00* (2006.01)

(52) U.S. Cl. ..... 601/150; 601/152

(58) Field of Classification Search ..... 601/41–44, 601/148–152; 602/13; 128/DIG. 20
See application file for complete search history.

(56) References Cited

U.S. PATENT DOCUMENTS

| | | | |
|---|---|---|---|
| 2,223,570 | A | 12/1940 | McMillin |
| 2,241,444 | A | 5/1941 | Bower |
| RE24,357 | E | 9/1957 | Emerson |
| 3,043,292 | A | 7/1962 | Mendelson |
| 3,078,842 | A | 2/1963 | Gray |
| 3,368,550 | A | 2/1968 | Glascock |
| 3,859,989 | A | 1/1975 | Spielberg |
| 3,878,839 | A | 4/1975 | Norton et al. |

(Continued)

FOREIGN PATENT DOCUMENTS

WO WO 9628129 A1 * 9/1996

OTHER PUBLICATIONS

Article on External Counterpulsation, Management of Cardiogenic Shock After Myocardial Infarction, pp. 1193-1202 and Table 1, p. 1442.. vol. 229, No. 11, Journal of American Medical Association, Sep. 1974.

*Primary Examiner* — Danton DeMille
(74) *Attorney, Agent, or Firm* — Lerner, David, Littenberg, Krumholz & Mentlik, LLP

(57) ABSTRACT

A method and system for treating a patient having an acute myocardial infarction. Such system may comprise at least one tank having a pressurized gas contained therein, at least one housing having a shell and being adapted to at least partially surround a body segment of the patient, a hose/valve device for supplying the compressed gas from the tank to the housing; and a control device for controlling the flow of compressed gas from the tank to the housing in accordance with cardiac systole and cardiac diastolic of the patient to vary the pressure in synchronization with the patient's heart function. The system may be arranged within a moving vehicle, such as an ambulance, an airplane, or a ship.

8 Claims, 9 Drawing Sheets

U.S. PATENT DOCUMENTS

| | | | | |
|---|---|---|---|---|
| 4,003,378 | A | | 1/1977 | Pickering |
| 4,257,407 | A | | 3/1981 | Macchi et al. |
| 4,320,746 | A | * | 3/1982 | Arkans et al. ..... 601/152 |
| 4,481,938 | A | | 11/1984 | Lindley |
| 4,621,621 | A | | 11/1986 | Marsalis |
| 4,770,165 | A | | 9/1988 | Hayek et al. |
| 4,824,105 | A | | 4/1989 | Goldenberg |
| 5,222,478 | A | | 6/1993 | Scarberry et al. |
| 5,279,283 | A | | 1/1994 | Dillon |
| 5,554,103 | A | | 9/1996 | Zheng et al. |
| 5,562,604 | A | | 10/1996 | Yablon et al. |
| 5,900,299 | A | | 5/1999 | Wynne |
| 5,997,540 | A | | 12/1999 | Zheng et al. |
| 6,846,294 | B2 | | 1/2005 | Rastegar et al. |
| 7,074,200 | B1 | | 7/2006 | Lewis |
| 2002/0115949 | A1 | * | 8/2002 | Kuslich et al. ..... 601/152 |
| 2003/0216672 | A1 | | 11/2003 | Rastegar et al. |

* cited by examiner

FIG. 9
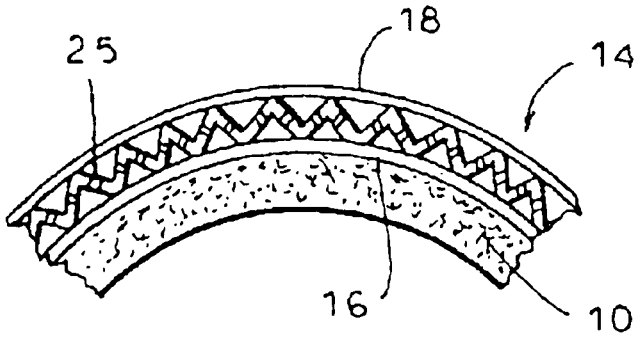
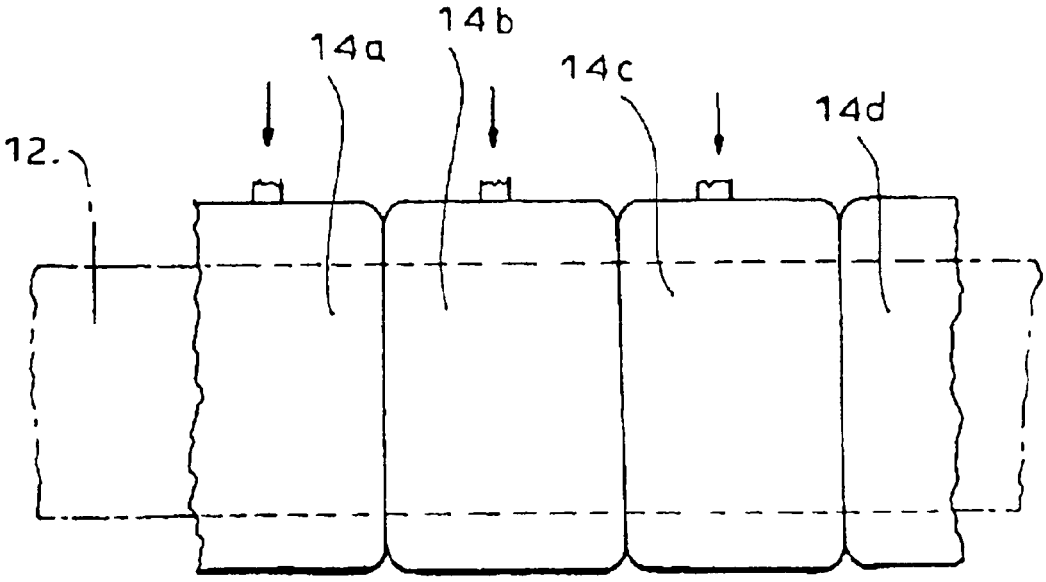
FIG. 10

EXTERNAL COUNTERPULSATION (ECP) DEVICE FOR USE IN AN AMBULANCE OR THE LIKE FOR HEART ATTACK PATIENTS TO LIMIT HEART MUSCLE DAMAGE

CROSS-REFERENCE TO RELATED APPLICATIONS

This application is a continuation-in-part of U.S. application Ser. No. 11/009,222, filed on Dec. 10, 2004, which is a Continuation of U.S. application Ser. No. 09/851,930, filed on May 10, 2001 now U.S. Pat. No. 6,846,294, the disclosures of which are incorporated herein by reference. The present application also claims the benefit of the filing date of U.S. Provisional Application No. 60/808,450, filed May 25, 2006, the disclosure of which is hereby incorporated by reference herein.

BACKGROUND OF THE INVENTION

1. Field of the Invention

The present invention relates to an external counterpulsation cardiac assist device which may apply positive and/or negative relative pressure to one or more limbs of a patient and, more particularly, to such device having a housing which may be used for applying positive and/or negative relative (to atmospheric) pressure to the limbs in counterpulsation with heart function, which is adapted to be assembled in situ to provide customized fit and which may use a relatively small amount of gas.

2. Description of the Related Art

A method of assisting the circulation without invading the vascular system by the external application of intermittent pressure to the body has been known. Studies have shown that application of a positive relative pressure pulse to the lower extremities during cardiac diastole can raise the diastolic pressure by 40% to 50% while the application of negative relative pressure (vacuum), during cardiac systole can lower the systolic pressure by about 30%. Hereinafter, by "relative" pressure, it is meant relative to the atmospheric (gauge) pressure.

This externally applied positive and negative relative pressure increases the venous return to the heart because of the unidirectional valves in the peripheral venous bed. In cariogenic shock accompanied by myocardial ischemia, the increased coronary flow may improve cardiac function and thus indirectly affect the hemodynamic response to this procedure. It is further believed to promote the growth of collateral channel blood vessels feeding heart tissue and to reduce the symptoms of angina.

The therapeutic results of the above-mentioned method have been well documented. However, as a practical matter, an apparatus previously used to externally apply positive and negative relative pressure to the limbs has been extremely inefficient and therefore the procedure has not found wide acceptance. More specifically, such apparatus employed for this purpose included a prefabricated hinged conical metal housing or shell housing. Within the housing, a hollow cylindrical inflatable rubber balloon-like tube was placed, within which the limb segment was situated. The balloon-like rubber tube was filled with water, which was pressurized to inflate the tube, thereby filling the interior of the housing and applying pressure to the surface area of the limb segment. To apply negative relative pressure, the water was first pumped out of the rubber tube, leaving an air gap between the rubber tube and the limb. An impermeable, rubber-like coated fabric was placed around the exterior of the housing, and was sealed around the limb to trap the air between the limb and the rubber tube. By pumping out the air trapped within the sealed fabric, the fabric first collapsed around the housing, and then negative pressure began to form within the gap between the limb and the rubber tube.

This previous apparatus or system had numerous operational difficulties. Due to high resistance to flow, pressurizing the rubber tube and pumping the water out of the rubber tube fast enough to match the heart beat was very difficult if not nearly impossible. As the result, even the process of applying positive relative pressure was very difficult. The process was made even more difficult since a prefabricated housing could not be made to closely fit every patient. As a result, a relatively large gap may have been left between the rubber tube and the limb to be filled by the expanding rubber tube. In such situation, the amount of air that had to be pumped out of the rubber-coated fabric enclosed space around the housing and in between the limb and the rubber tube was relatively large, thereby requiring large air pumping action. In addition, due to the flexibility of the rubber-coated fabric, it would tend to deform and enter the space between the limb and the rubber tube, thereby making it difficult to achieve the desired level of negative pressure (vacuum) around the limb.

Other apparatus or applicators may utilize a prefabricated and relatively non-extensible fabric within which a balloon-like element is located. The balloon-like element with its enclosing housing or cuff is wrapped around the limb and secured by straps equipped with hook and loop tape, commercially known as VELCRO. Such applicators may be or may have been supplied from Vassmedical, Inc. of Westbury, N.Y.

During operation, the balloon is pressurized by air, thereby applying pressure to the surface of the enclosed limb. Due to the bulging and deformation of the cuff as the balloon is pressurized, a relatively large volume of air is required to achieve the required limb surface pressure. This is the case even though the cuff material is relatively non-extensible and the cuff may be applied snugly to the limb segment. As the result, large capacity pumps are required to drive the apparatus because of the large volume of air which has to be rapidly moved in and in most cases out of the balloons, to alternatively inflate and deflate the balloons, to apply the required pressure to the limb. Additionally, this applicator and all variations thereof that use balloons to apply pressure, cannot be used to apply relative negative pressure to the limb. Another disadvantage of such applicators is that due to the requirement of a large air volume, the system is rendered non-portable, and hence cannot be made available outside a fixed treatment room and may not be available in emergency situations.

An attempt was made to develop design concepts with a rigid or semi-rigid outer shell which surround an inflatable balloon-type interior. An applicator of this type is illustrated in U.S. Pat. No. 5,554,103 issued Sep. 10, 1996 to Zhang, et al. and U.S. Pat. No. 5,997,540 issued Dec. 7, 1999 to Zhang, et al., both of which are owned by Vasomedical, Inc. of Westbury, N.Y. Those applicators are described to be wrapped around the limb and held in place with some means such as straps of VELCRO. However, such prefabricated applicator designs cannot closely fit the limb and thus still require a large volume of air to provide the required limb surface pressure level. This is the case since such prefabricated applicators cannot be made to precisely fit a limb segment, thereby leaving a significant dead space between the balloon-like tube and the limb.

The aforementioned patents propose to fill the dead space by spacers to reduce the amount of air required for the operation of the applicator. These spacers have to be cut in various shapes and thicknesses and therefore are highly cumbersome and impractical.

The outer shells and applicators may be custom made to fit the limb segments. A large number of applicators of various sizes and shapes may also be fabricated to nearly accommodate the contour of the limbs of various patients. As is to be appreciated, custom made applicators may be impractical. As also is to be appreciated, fabricating and/or maintaining an inventory of a large number of applicators of different sizes and shapes suitable for a wide variety of different size patients such as for a hospital may also be impractical.

In addition, since such applicators may operate by pressurizing balloon-like tubes around the limb segment, they cannot be used to apply negative relative pressure to the limb segment.

SUMMARY OF THE INVENTION

The present invention overcomes these disadvantages through use of a uniquely designed applicator housing with an internal air distribution system. The applicator may be custom fit to the limb and may therefore use much less air volume to operate than the above-mentioned systems. Since less air volume is used to operate the housing, much smaller capacity, much lighter and less expensive air pumps may be utilized. Because the applicator housing may be assembled in situ from deformable components which are rigidified as they are secured on the patient, and thus can be customized for each patient, the necessity of inventorying large numbers of prefabricated housing components is eliminated while, at the same time, the preciseness of the fit for each individual patient is greatly enhanced.

The amount of air volume required is reduced because the gap between the shell and the limb surface can be made very small, thereby minimizing the total space which must be pressurized. The main limitation in employing such a small gap between the shell and limb surface is the resistance to the air flow in and out of the shell. However, air flow is readily enhanced by the internal air distribution system of the shell and by employing multiple air inlets to the shell.

Further, by minimizing the volume of air required, substantially the same air can be rapidly pumped in and out of the housing to generate positive and/or negative relative pressures in a relatively closed system. This provides an efficient means to control the air pressure, and also permits the air temperature to be closely controlled. Controlling the temperature of the air may be important because warmer air may promote vascular dilation, resulting in greater blood flow and hence more efficient operation of the apparatus.

In addition, due to the use of a relatively rigid shell with an internal air distribution system, the inflatable balloon-like interior of the prior systems may be eliminated. This permits the applicator of the present invention to apply both negative as well as positive relative pressure to the limb. The Vasomedical applicators, for example, cannot apply negative relative pressure.

The present invention may provide an external counterpulsation cardiac assist device with applicators capable of applying both positive and negative relative pressure to the limb.

The present invention may provide an external counterpulsation cardiac assist device with an applicator that utilizes a relatively small air volume to operate, and hence may use a reduced pump capacity and/or may operate with a relatively small container of a pressurized gas.

The present invention may provide an external counterpulsation cardiac assist device which eliminates the use of an inflatable balloon-like tube.

The present invention may provide an external counterpulsation cardiac assist device which includes a positive and/or negative relative pressure applicator which can be assembled in situ, and thus customized to precisely fit the limb of each patient.

The present invention may provide an external counterpulsation cardiac assist device that is significantly lighter than the existing systems, thereby enabling it to be portable such that it can be placed in a moving vehicle such as an ambulance, an airplane, a ship and so forth and/or moved to the patient, rather than requiring the patient to go to a specially equipped facility for treatment.

The present invention may provide an external counterpulsation cardiac assist device in which the air temperature can be readily controlled to promote vascular dilation.

The present invention may provide an external counterpulsation cardiac assist device having an applicator with a relatively rigid shell that can be readily secured to the limb segment while sealing the applicator inner chamber around the limb segment.

The present invention may provide an external counterpulsation cardiac assist device that may be used with an air permeable, inner layer which may cover the limb segment over which a relatively rigid shell is secured and sealed.

The present invention may provide an external counterpulsation cardiac assist device which may include a positive and negative relative pressure applicator with a rigid or semi-rigid shell having an internal air distribution system within the sealed exterior shell, which may be spaced apart from the limb surface by radial and/or longitudinal elements defining a tubular chamber adapted to be connected to a pumping system and/or a container of pressurized gas which may operate to move air into and out of the chamber, in synchronization with the operation of the heart.

The applicator of the present invention may provide positive relative pressure application and/or negative relative pressure (vacuum) application to the limb by pressurizing and developing a vacuum within the sealed interior of the housing. The shell which defines the interior of the housing is sufficiently rigid and non-expandable, once secured around the limb, so as to contain the positive pressure and sufficiently non-collapsible to permit a significant vacuum to be developed.

In one embodiment of the present invention, the interior shell wall may be spaced from the exterior shell wall by radial and/or longitudinal elements so as to define a tubular chamber. The chamber is adapted to be connected to a pump and/or to a container having a pressurized gas (such as air) which enables air to be moved into and out of the chamber, in synchronization with the operation of the heart.

The shell may be initially deformable so that it can be fashioned to closely conform to the shape and size of the limb. Once in place, the interior of the shell may be sealed. The shell may become relatively rigid once it is secured.

An inner layer may be situated within the shell interior, adjacent to the limb. This layer may be made of highly air permeable material, such as fabric, felt or sponge-like materials, which are flexible in bending but relatively resistant to pressure, i.e., not readily compressed under pressure.

The shell components may be initially separate from the permeable inner layer. The tubular space between the walls of the shell may define an internal air distribution system which allows free flow of air between the pump and/or container and the permeable inner layer within the shell interior. The permeable inner layer may provide minimal resistance to the air flow.

The positive and/or negative relative pressure cycle and its time profile may be controlled by a microprocessor based computer system which receives input from an electrocardiogram or other heart function monitoring device. The positive relative pressure may be provided by an air compressor, a pressurized air tank and/or an air pump. Negative relative pressure can be provided by a vacuum pump. However, a spring-loaded pump mechanism which provides both positive and negative relative pressure, as described below, may be utilized.

In accordance with one aspect of the present invention, an external counterpulsation cardiac assist device is described for providing positive and negative relative pressure to a segment of the body in synchronization with the operation of the heart. The device includes a housing. The housing may include a relatively rigid tubular shell surrounding the body segment and an air permeable flexible inner layer situated within the shell interior, proximate the body segment. Means are provided for sealing the shell interior. The shell may have an internal air distribution system which operably connects the air supply and the shell interior.

The shell may be formed by spaced interior and exterior walls. Spacing means may be interposed between the shell walls, defining an air chamber therebetween. The interior shell wall may have a plurality of openings facilitating free flow of air between the chamber and the shell interior.

One or more ports in the exterior shell wall may be provided. Such port or ports operably connect the chamber and an air supply.

The spacer means may separate the internal air chamber of the shell into sections. Air passages are provided through the spacer means to connect the chamber sections. The spacer means can have radially or longitudinally extending spacer walls. Other shapes, such as honeycomb or the like, are useable as well, depending upon the configuration.

The interior shell wall and the spacer means may be joined to form an assembly. The exterior shell wall may be situated over the assembly. Means are provided for securing the exterior shell wall over the assembly to rigidify the shell.

The interior shell wall may be composed of relatively rigid material such as a sheet of plastic or hard rubber, or of a plurality of articulately connected sections of plastic or the like or metal sections.

The inner layer may be comprised of fabric, felt or sponge like material. The layer may be hard enough to resist the pressure of the interior shell wall during the assembly of the applicator, but flexible enough not to provide significant resistance to the expanding limb during the application of the negative relative pressure. The material may also be flexible enough for significant bending so as to be readily formed to the shape of the limb during the assembly.

The exterior shell wall may be air impermeable and composed of flexible but non-extensible sheet material, such as various types of sealed fabrics or plastic.

The interior shell wall and spacer means may be integral. Alternatively, both the shell walls and the spacer means may be integral.

The means for sealing the shell over the inner layer may comprise sealing tape. The means for securing the exterior shell wall may comprise straps or bands which are relatively non-extensible.

The exterior wall may be kept in position relative to the top of the spacers by sections of hook and loop tape or simply by friction enhancing roughened surfaces. In such cases, the top surfaces of the spacer walls may be enlarged to enhance the securing action.

In another preferred embodiment of the present invention, the shell may consist only of an exterior wall. No interior wall is used. An air permeable flexible inner layer may be placed over the body segment. Spacer means may separate the air permeable inner layers from the exterior shell wall, forming an interior air chamber. The spacer means may separate the internal air chamber of the shell into sections. Air passages may be provided through the spacer means to connect the chamber sections. The spacer means can have radially or longitudinally extending spacer walls. Other shapes, such as honeycomb or the like, are usable as well.

As in the previous embodiment of the present invention, means are provided for sealing the shell interior. The internal air distribution system of the shell operably may connect the air supply and the shell interior. One or more ports in the exterior shell wall are provided to operably connect the shell interior chamber and the air supply.

The spacer means and the exterior shell wall may be integral. Alternately, the spacer means and exterior shell wall may be separate, in which case the spacer means may be cut and assembled around the air permeable flexible inner layer. The exterior wall may then be situated over the assembly. Means are provided for securing the exterior shell wall over the assembly to rigidify the shell.

The inner layer described in the previous embodiment may or may not be utilized in this embodiment. If it is not used, the spacer means may be situated proximate the body segment.

In another preferred embodiment of the present invention, an external counterpulsation cardiac assist system for treating a patient having an acute myocardial infarction is provided. This system may comprise at least one tank having a pressurized gas contained therein; at least one housing having a shell and being adapted to at least partially surround a body segment of the patient, the shell having an interior wall and an exterior wall, the interior shell wall containing air transfer openings permitting air flow into a space interior to the interior wall and spacer means having a number of elements sufficiently rigid to maintain the exterior wall in spaced relation with the interior shell, the elements having air transfer openings so as to permit air flow between the walls; means for supplying the compressed gas from the tank to the housing; and means for controlling the flow of compressed gas from the tank to the housing in accordance with cardiac systole and cardiac diastolic of the patient to vary the pressure within the space in synchronization with heart function. A method corresponding thereto is also provided.

Throughout this specification, the present invention is described for purposes of illustration as being air driven. While air is the preferred fluid for many reasons, including low viscosity, non toxicity, non flammability, availability, etc., it should be understood that other gases or liquids could be used.

To these and to such other objects which may hereinafter appear, the present invention relates to an external counterpulsation cardiac assist device as described in detail in the following specification, recited in the annexed claims and illustrated in the accompanying drawings, wherein like numerals refer to like parts.

BRIEF DESCRIPTION OF THE DRAWINGS

FIG. 9 is a cross-sectional view showing a section of the shell of another embodiment of the present invention;

FIG. 10 is a side elevation view of another embodiment of the present invention;

DETAILED DESCRIPTION

Figure 1:
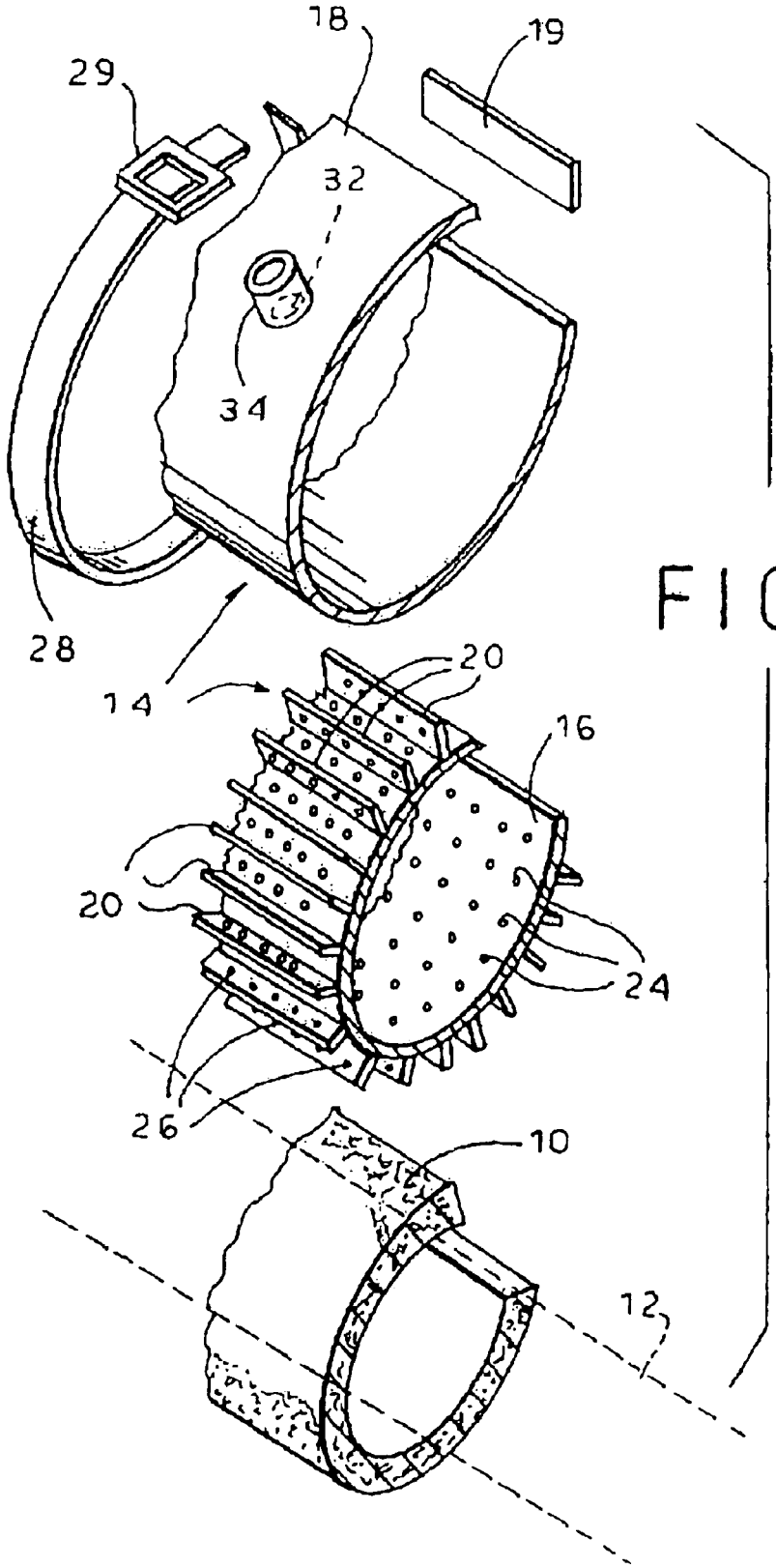
FIG. 1 is an exploded isomeric view of a section of a first preferred embodiment of the device housing.
Figure 2:
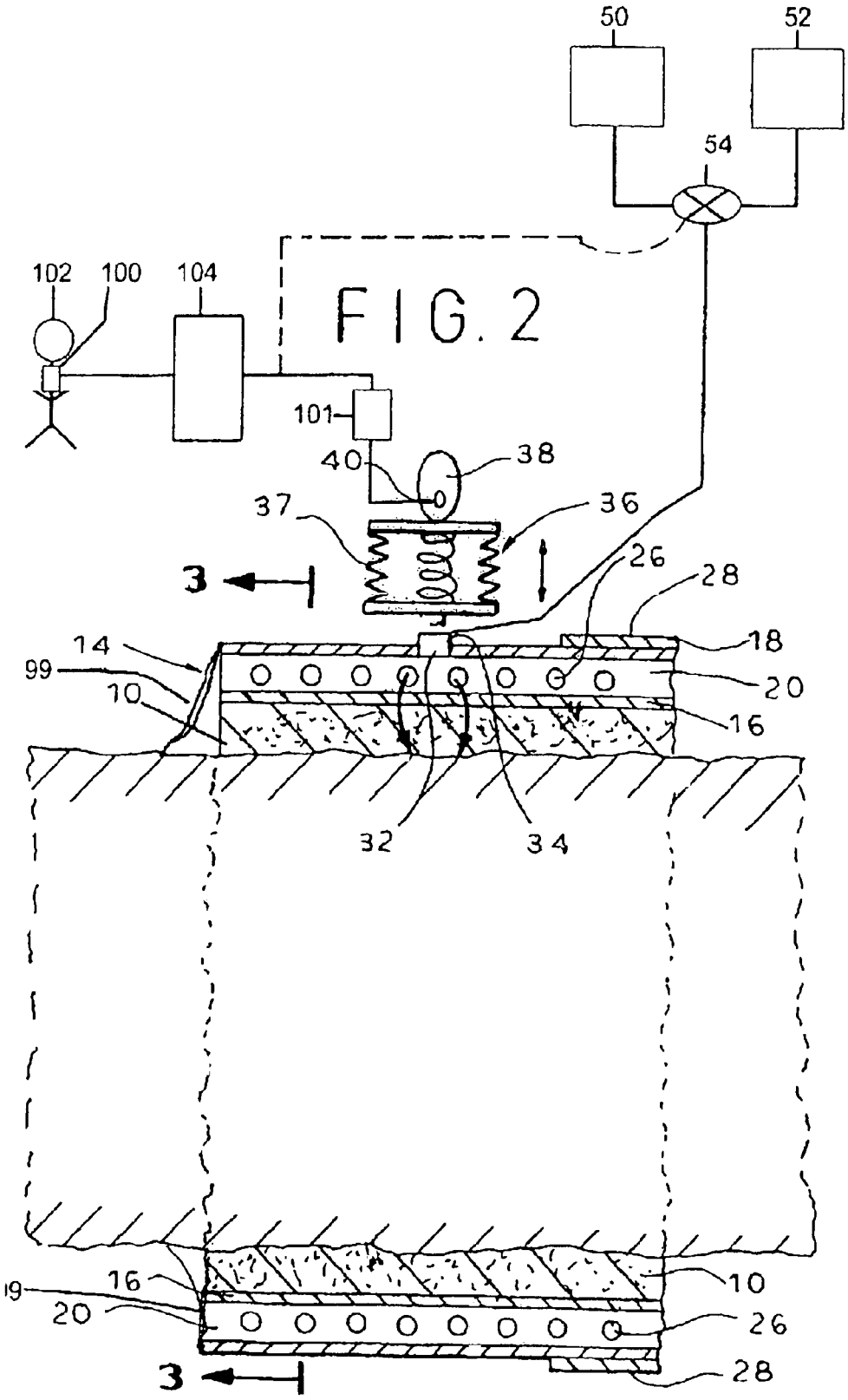
FIG. 2 is a cross sectional view of the housing of FIG. 1, as it would appear mounted on the limb of a patient, along with other elements of the present system.
Figure 3:
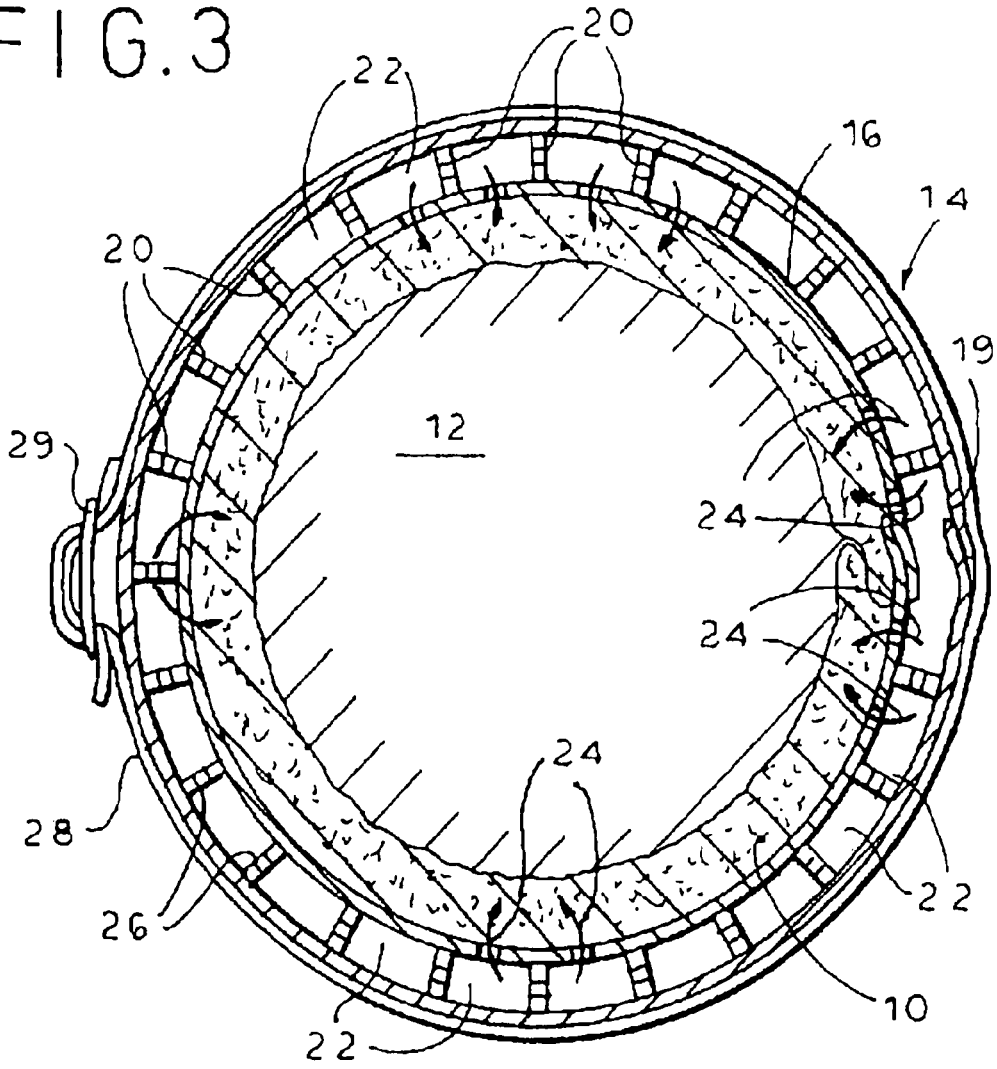
FIG. 3 is a cross-sectional view taken along line 3-3 of FIG. 2.

The embodiment of the invention, illustrated in FIGS. 1, 2 and 3, consists of a tube-like housing, a typical precut section of which is illustrated. The housing is adapted to be assembled in situ, and custom fitted to a limb, such as an arm or leg or to entire lower portion of the body, including the thighs and buttocks. The housing may consist of a flexible, air permeable inner layer 10 composed of a sheet of fabric, felt or sponge-like material. Inner layer 10 may be placed around the limb 12 and trimmed to size using a scissor or blade.

Around inner layer 10 is tightly fitted a hollow shell 14 which is initially deformable enough to closely conform to the contours of the limb. After shell 14 is sealed and secured in place around the limb as described below, it will become relatively rigid.

Shell 14 may consist of an interior wall 16 and an exterior wall 18. Walls 16 and 18 may be spaced apart by a plurality of upstanding spacer elements 20, so as to form an internal air distribution system defined by air flow chamber 22 between the shell walls.

Figure 4:
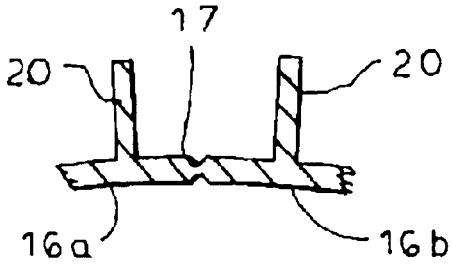
FIG. 4 is a cross-sectional view showing a portion of adjacent sections of the interior shell wall which are connected by a "living hinge;"
Figure 5:
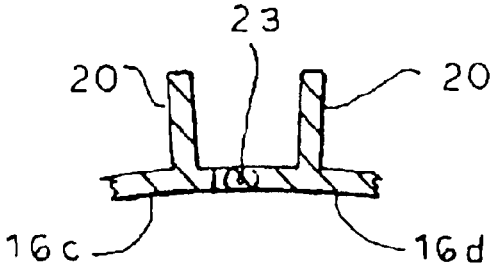
FIG. 5 is a view similar to FIG. 4 but showing a portion of adjacent sections connected by a hinge.

Interior shell wall 16 may have a plurality of openings 24 which permit the free flow of air between chamber 22 and the shell interior. Openings 24 may be arranged in a pattern which is determined by the configuration of the spacer elements. Wall 16 may be relatively rigid particularly in the transverse and longitudinal directions. It can be formed of a single, initially deformable sheet of hard rubber or plastic 16, as shown in FIGS. 1, 2 and 3, or sections 16*a*, 16*b* of hard rubber or plastic connected by "living hinges" 17, as shown in FIG. 4, or sections 16*c*, 16*d* of metal connected by mechanical hinges 23, as shown in FIG. 5. If rubber or plastic, the sections of wall 16 can be provided flat and then deformed as required to fit snugly around inner layer 10.

Figure 7:
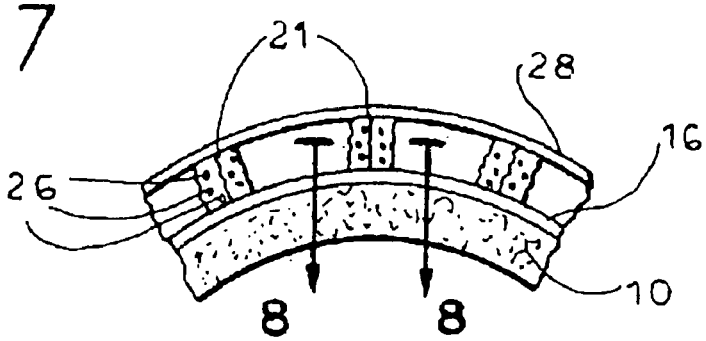
FIG. 7 is a cross-sectional view of a section of the shell of yet another embodiment of the present invention.
Figure 8:
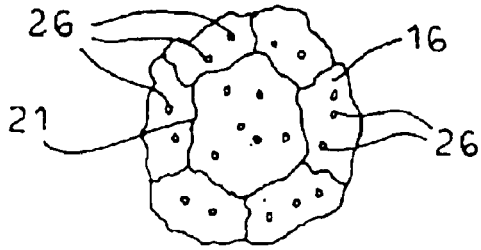
FIG. 8 is a cross-sectional view taken along line 8-8 of FIG. 7.
Figure 11:
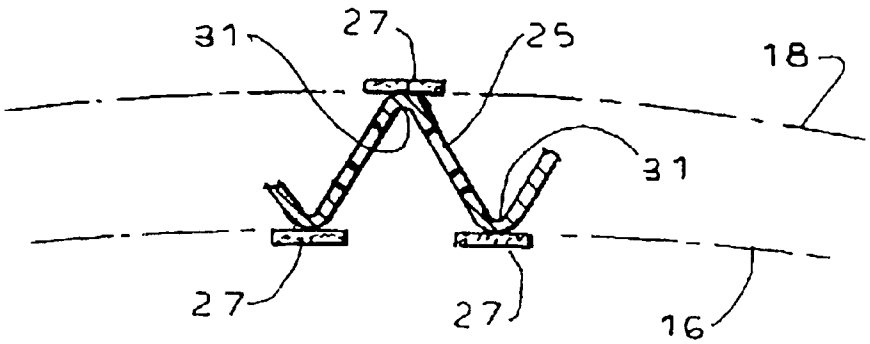
FIG. 11 is a cross-sectional view showing a section of the shell of another embodiment of the present invention.
Figure 14:
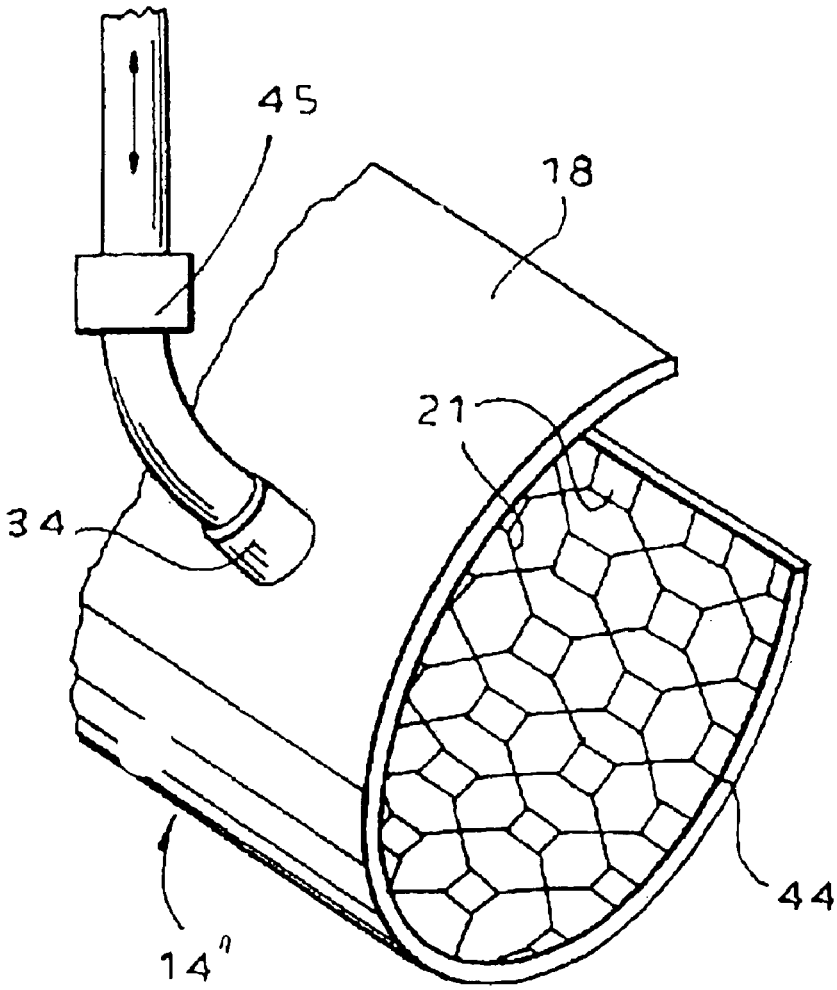
FIG. 14 is an isometric view of another embodiment of the present invention.

The spacer elements maintain the separation between the interior and exterior walls to insure free air flow throughout shell 14. These elements can take a variety of configurations, such as spaced, radially extending rectangular elements 20, as illustrated in FIGS. 1-6, honeycomb elements 21, as illustrated in FIGS. 7, 8 and 14, or spacer 25 with a bellows-like configuration, as illustrated in FIGS. 9 and 11. The spacer elements may be composed of the same material as wall 16. Whichever form of spacer elements is utilized, a plurality of air passageways 26 may be provided through each spacer element such that the air will flow freely between the sections of chamber 22, defined by the spacer elements.

The spacer elements may be formed integrally with interior shell wall 16, as illustrated in FIGS. 1-6. However, in a situation where the elements are interconnected so they can stand alone as a unit, such as the honeycomb elements 21 of FIGS. 7, 8 and 14 or in the bellows-like spacer 25 of FIGS. 9 and 11, the spacer may be supplied in rolls or sheets, separately from wall 16. In that case, the spacer may be trimmed appropriately and mounted over inner layer 10, if wall 16 is not present, as shown in FIG. 14 or over wall 16, after wall 16 is situated around inner layer 10. As illustrated in FIG. 11, hook and loop tape strips 27 can be used at the corners of spacer 25 in conjunction with hook and loop strips 31 on walls 16 and 18 to provide a more slip resistant fit relative to the shell walls.

The housing is completed by the installation of a relatively flexible (in bending) but non-extensible exterior wall 18, which is secured to hold the structure together tightly around the limb and sealed to provide an air tight or substantially air tight seal, isolating the interior of the housing. Wall 18 may be made of a flexible material, such as plastic, reinforced plastic, fabric or the like or elastomer sheets of sufficient thickness (stiffening) to withstand the pressure changes which will be applied to the housing, minimally deform during this process and to maintain the tight fit of the housing.

Wall 18 may be supplied on rolls or in sheets and trimmed as required. It may then be placed tightly over the interior wall and spacer assembly. The edges of wall 18 are overlapped and sealed to each other to form an air tight or substantially air tight joint using hook and loop tape or by strips of adhesive sealing tape 19 or the like. The ends of the housing are likewise sealed to the limb by adhesive sealing tape 99 or other means such as clamps or belts to prevent air from escaping.

Belts or straps 28 may also be used to encircle the housing at various locations along its length and tightened to maintain the secure fit of the housing. This causes the shell to become sufficiently rigid to withstand the rapid pressure changes. Belts or straps 28 may be flexible in bending but relatively inextensible and may have buckles or other fastening means 29. Hook and loop tape can be used to secure the exterior wall or to make the inner wall slip resistant.

Figure 6:
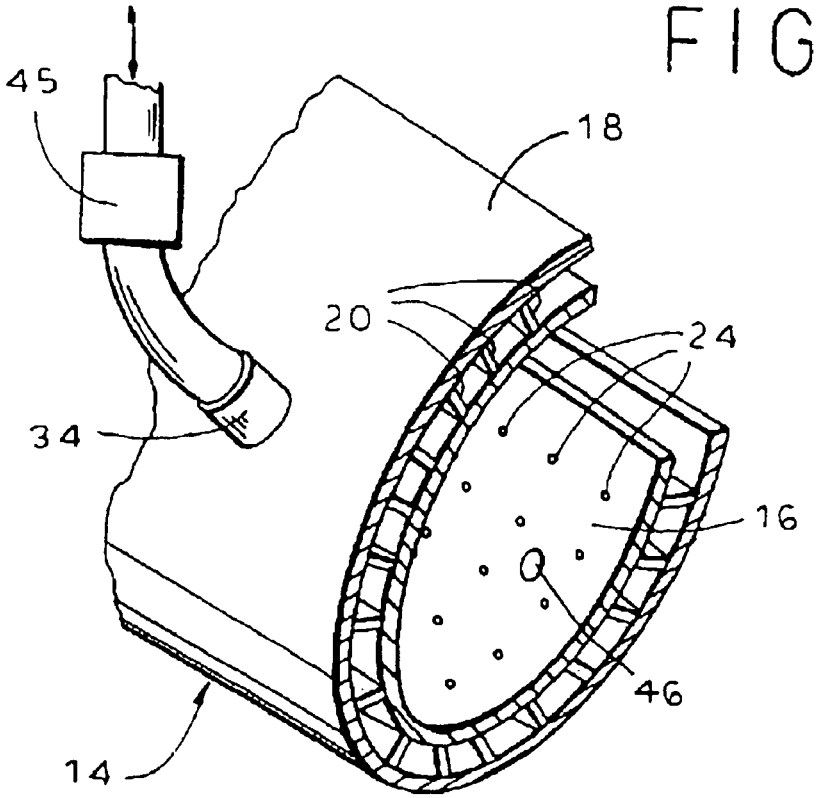
FIG. 6 is an isometric view of a section of the shell of another embodiment of the present invention.

FIG. 6 illustrates an embodiment of shell 14' in which the walls 16, 18 and spacer elements 20 are all integral, such that the shell 14' is a unitary structure. In this case, the shell 14' is initially deformable and may be provided on a roll or in sheet form. Shell 14' is then cut and trimmed appropriately, wrapped around the inner layer 10, sealed and secured.

Instead of providing the shell in rolls or sheets, it is possible to provide it in sections of a predetermined size, such as each may be several inches wide, which are individually fitted around the inner layer surrounding the limb, adjacent to each other, in side by side relation, transverse to the axis of the limb. The sections may be sealed together with sealing tape and secured with belts or straps 28, as necessary. The transverse sectional embodiment is illustrated in FIG. 10, which shows a shell formed of a plurality of contiguous shell sections 14*a*, 14*b*, 14*c* and 14*d* extending transverse to the axis of the limb. Using transverse shell sections in this manner may permit even greater conformity to the shape of the limb and greater flexibility with regard to the length of the housing.

Figure 13:
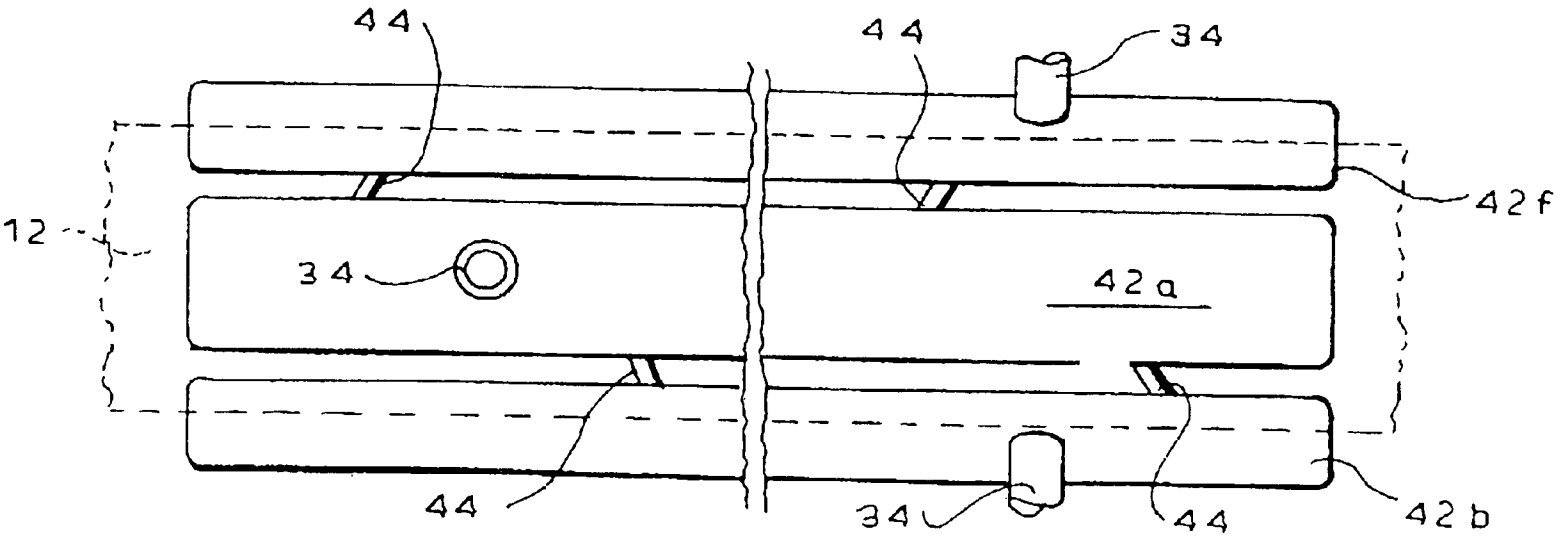
FIG. 13 is an elevational view of the embodiment illustrated in FIG. 11.
Figure 12:
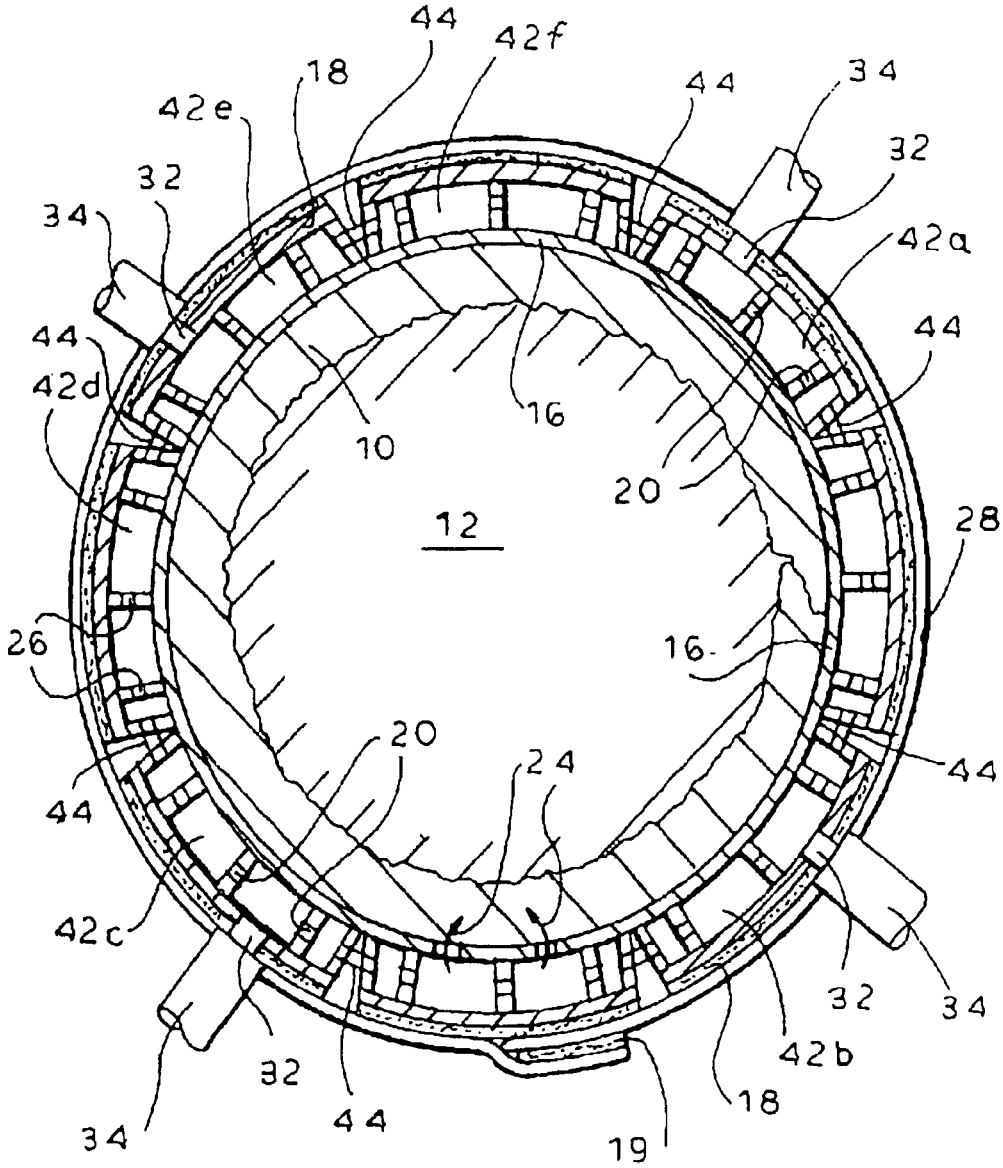
FIG. 12 is a cross-sectional view of another embodiment of the present invention.

FIGS. 12 and 13 illustrate another preferred embodiment of the present invention in which the shell is divided into longitudinal sections 42*a*, 42*b*, 42*c* . . . adapted to extend parallel to the axis of the limb 12. These sections may be connected together by hinges, preferably "living hinges." As in the other embodiments, sections 42*a*, 42*b*, 42*c* . . . surround inner layer 10 of porous material which could be fabric, sponge-like or the similar materials. The inner wall of each section 42 may be provided with multiple air openings 24. Each section 42 may include spacer elements 20 such that internal air chambers 22 are formed. Sections 42*a*, 42*b*, 42*c* . . . may be connected together by flexible tubes 44 to permit air to pass freely therebetween. One or more connectors 34 may be provided for connection to the air source.

The sections 42*a*, 42*b*, 42*c* . . . may be surrounded by belts or strips 28 to secure the housing around the limb and to render it relatively rigid. These securing means can be made of hook and loop tape or other inextensible fabric.

FIG. 14 illustrates the preferred embodiment of shell 14" in which the inner layer 10 and the interior wall 16 are absent. Spacer means 21 are shown as honeycomb in configuration.

Air may be moved into and out of internal shell chamber 22 thorough one or more ports 32 in exterior wall 18. Each port 32 is provided with a connector 34 of conventional design to permit a hose or conduit to be connected between the port and the air source.

As indicated above, the fluid used is preferably air, but could be other gases or even liquids, such as water. However, since the fluid must move in and out of the housing rapidly, a low viscosity fluid is preferred.

For some applications, and with reference to FIG. 2, compressed air from tanks 50 can be used for the application of positive relative pressure and the internal air chamber can simply be vented to relieve the pressure. However, if negative relative pressure is required, vacuum creating equipment 52 may be utilized. Tanks 50 and vacuum equipment 52 can be connected to the housing by suitable valving 54.

FIG. 2 illustrates, in schematic form, a pump 36 which could be used to supply to and remove air from the housing. Pump 36 may include air tight bellows 37 which contracts to push air into the internal, air flow chamber of the shell to pressurize the housing and expands to draw air out of the chamber to create a relative vacuum within the shell interior. The expansion and contraction of the bellows may be controlled by an off-center cam 38 which rotates on a shaft 40. Shaft 40 may be driven by an electric motor 101, through a commonly used speed reduction and controlled clutch system to operate the pump in accordance with the signals sensed by an electrocardiograph or other heart function monitoring device 100 which may be coupled to a patient 102. Pump 36 may be spring loaded toward the expanded condition of bellows 37 such that negative relative pressure (vacuum) is provided during each cycle. The appropriate valving may be provided between the pump and the housing ports, so as to feed air to the ports.

A microprocessor based computer device or system 104 may be coupled to the electrocardiograph or heart function monitoring device 100 and may receive information signals therefrom indicative of the patient's heart function or operation, such as information signals pertaining to cardiac diastole and cardiac systole. The computer system 104 may produce a control signal in accordance with the received cardiac diastole and cardiac systole information signals and supply the same to the motor 101 and/or the value 54 and/or other such device to control the flow of air into and/or from the housing in accordance with the cardiac diastole and cardiac systole of the patient 102.

In FIG. 2, for the sake of simplicity, the mechanism of affecting expansion and contraction of the bellows is shown to be by an off-center cam driven by an electric motor. However, other devices or mechanisms could also be used such as any mechanism of producing linear motion by electric power, e.g., a lead screw mechanism, or a linear electric motor with appropriate motion transmission and controller. In addition, since the positive relative pressure and relative vacuum generation periods are only a portion of the full cycle of operation of the system, the electric motor driving the pump can be used to store mechanical energy in the form of potential energy in the pump spring and in motor mounted flywheels. This would greatly reduce the size of the electric motor required to operate the pump.

The pump 36 shown in FIG. 2 is uniquely suited for use with the housing of the present invention because together they form a closed system in which the same air is moved back and forth between the pump and the housing as the bellows 37 expands and contracts. This permits the use of a smaller capacity pump and greater control over the temperature of the air within the housing. The smaller capacity pump permits the apparatus to be portable such that it can more easily be brought to a patient in an emergency situation. Of course, the capacity of the pump is determined by the size of the housing it is being used with.

A heater element 45 and a temperature sensor 46 may be employed to maintain the temperature of the air which is introduced into the housing at an elevated level, as shown in FIG. 6. Heat promotes vascular dilation and hence increased blood flow, resulting in an increase in the effectiveness of the device.

Other possible air sources could include a "double acting" pump, eliminating the need for the internal spring. Such a pump may provide more accurate control over pressure levels and profiles. Piston pumps and rotary pumps could be used as well.

More than one air source could also be used. For example, multiple pumps, operating synchronously, may be used which provide more uniform pressure application. The pumps could be set up to permit the system to operate at a higher number of cycles per second than a single pump. If used alternately, one pump or set of pumps could be compressing the air as the other forces the compressed air into the housing and visa versa.

Whatever type of air supply equipment is utilized, the volume of the shell interior and of the connection conduits should be kept to a minimum and the fit of the housing should be as close as possible to the contour of the limb. This reduces the volume of the space to be pressurized, the amount of air and vacuum required and hence capacity of the air supply pump and/or container.

Thus, the present invention relates to an external counterpulsation cardiac assist device which may include a sealed housing adapted to be assembled for custom fit and mounted around the limb and which may provide positive and/or negative relative pressure in synchronization with heart function. When positive and negative relative pressure is applied, it may alternate between positive and negative pressures. The housing may include an air permeable fabric-like inner layer surrounded by a relatively rigid but initially deformable shell. The shell may include an internal air flow distribution system defined between an initially deformable interior wall which can be made to snugly conform to the limb and a flexible exterior wall, separated from the inner wall by spacer elements so as to define an air flow chamber to facilitate the movement of air to and from the housing interior. The shell may be sealed around the limb by adhesive sealing tape 99 or the like and secured tightly to the limb by belts, straps or the like.

A description of an application of the present invention is now provided.

Acute myocardial infarction (AMI or MI), commonly known as a heart attack, is a serious, sudden heart condition caused by a blockage of a branch of the coronary arteries. This condition is usually characterized by chest pain or discomfort, weakness, sweating, nausea, vomiting, and arrhythmias, sometimes causing loss of consciousness and death. Since the area affected may be large or small, the severities of heart attacks vary, but they are often a life-threatening medical emergency which demand immediate attention.

According to the National Heart, Lung, and Blood Institute, approximately 7.5 million people in the U.S. are afflicted with AMI. Approximately 1.1 million Americans experience heart attacks annually with 650,000 being new events while 450,000 are recurrences. Males are at higher risk of myocardial infarction than women, and males are also more likely to suffer myocardial infarction earlier in life. However, heart disease kills more females each year than any other disease, including breast cancer. Over 500,000 American women die from cardiovascular disease each year—twice the number of deaths from all cancers combined.

The early application of external counterpulsation (ECP) devices may improve the circulation to a portion of the heart muscle that has been compromised by the acute myocardial infarction, and thus limit the amount of damage to the heart, and preserve heart muscle.

In the vast majority of the cases, acute myocardial infarction is a sudden heart condition that occurs away from a hospital and the patient is usually brought to the hospital by an ambulance. It is, therefore, critical to start ECP treatment by the medical personnel of the ambulance as soon as AMI is suspected or diagnosed. The patient should obviously be treated with ECP en route to the hospital as well. Current external counterpulsation machines may be large and heavy and require a considerable amount of power to operate that may not be available in regular ambulances. In these external counterpulsation machines, the heaviest components may be the compressor, the air storage, and related components.

A need, therefore, exists for ECP machines that are can be installed in ambulances and the like to treat heart attack patients while awaiting to be transported or while being transported to the hospital. Considering the fact that patient transportation is done in minutes and not hours, such ECP machines need to be operated for relatively short periods of time, which may be approximately 20-30 minutes or less. Considering the limitation in the required duration of treatment and the fact that the positive pressure can be less frequently applied than every heart beat, the present invention may use compressed air (or other gasses) supplied from a pressurized or compressed air tank or the like in place of a compressor or compressors to provide the required high pressure air to the ECP device. Alternatively, compressed air may be supplied from both a pressurized or compressed air tank (or the like) and from a compressor. In this latter situation, the compressed air supplied from the tank may be supplemented by air provided by a relatively small compressor that can be operated directly by the ambulance battery. The pressurized or compressed air tanks may be similar to those used by scuba divers and may have the air contained therein under a pressure of approximately 2000 psi or more. Alternatively, any other types of pressurized or compressed gas sources may be used.

In an embodiment, EKG (electrocardiogram) and/or blood pressure sensor information may be provided by a number of sensors coupled to the patient and may be directly provided to a central monitoring station, for example at the hospital, using an available wireless device. In general, both EKG and blood pressure pulse profile information may be used to control the operation of the ECP machine. Both EKG and blood pressure sensory information may be used because although the EKG signal indicates the timing of the heart pumping action, since the pressure application cuffs may be located away from the heart, the blood pressure pulse takes a certain amount of time to reach the affected arteries. In addition, this time lag may be different for different patients. For this reason, it may be highly desirable to monitor the profile of the blood pressure, e.g., one that is attached to a finger tip, and adjust the timing (manually or automatically) to achieve the desired pressure pulse during a portion of the cardiac systole.

Figure 15:
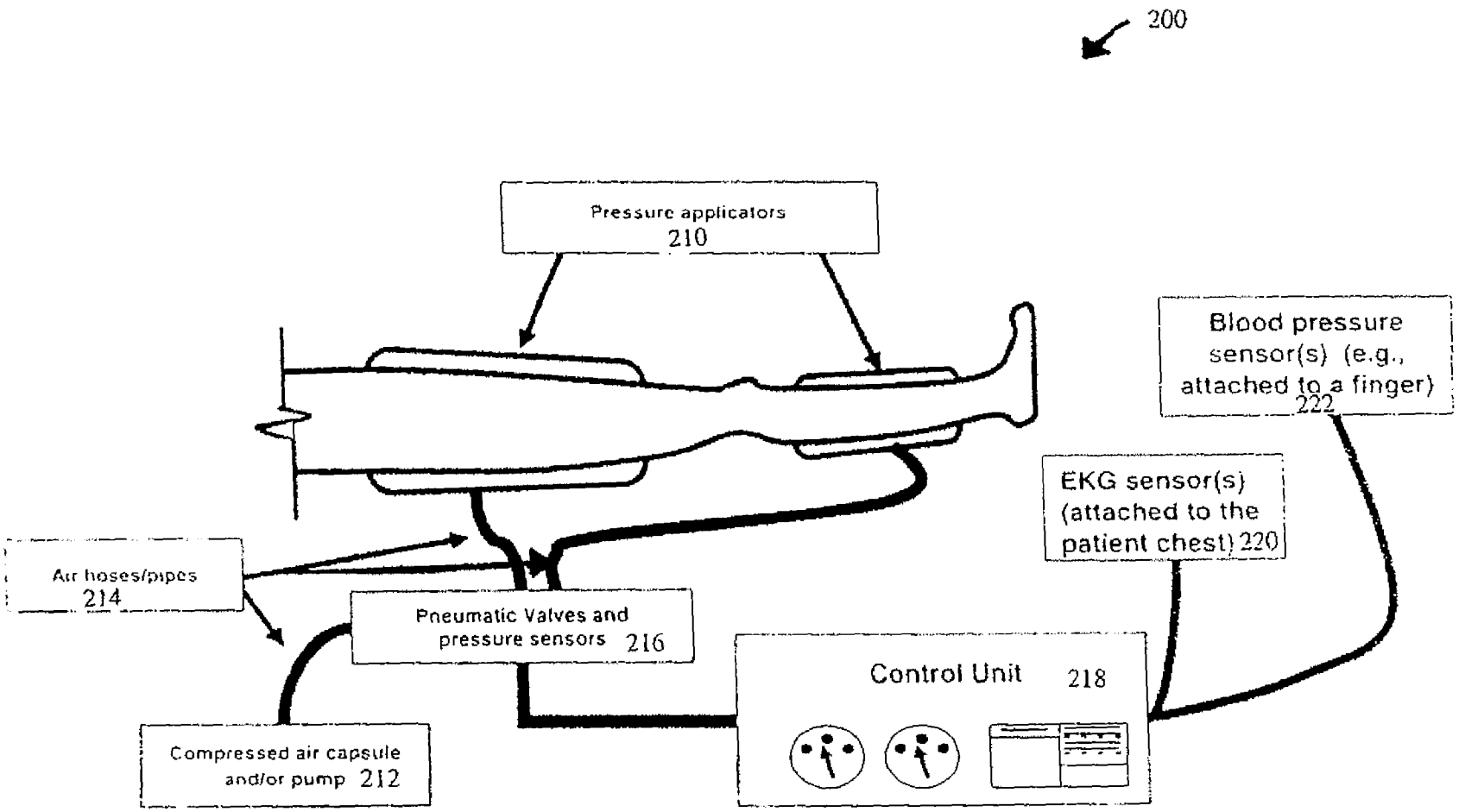
FIG. 15 is a diagram of a system according to another embodiment of the present invention.

A schematic drawing of a system 200 according to an embodiment of the present invention is shown in FIG. 15. As shown, such system may include a control unit 218 and a set of positive applicators 210 which may include one or more such applicators that are attached to at least one position on the legs, thighs, and/or buttock. The applicators 210 may be sealed housings with relatively rigid outer shells. Such applicators 210 may be the sealed housings described above. Alternatively, the applicators or cuffs may not be sealed housings and may not have relatively rigid outer shells.

The applicators 210 may enable positive relative pressure application to be provided to the enclosed limb by pressurizing the interior of the housings. A compressed air (gas) capsule/pump 212 may supply pressurized air to the applicators 212 by way a number of air hoses or pipes 214 and by use of a system 216 so as to apply a positive relative (to atmospheric) pressure thereto and/or through the use of the pump may cause a negative relative (to atmospheric) pressure to be applied thereto. The system 216 which may include a number of valves, such as electrically (or pneumatically, magnetically, etc.) activated pneumatic valves, may selectively supply the pressurized air to a specified applicator or applicators in a desired manner. The pneumatic valve system 216 may also allow the pressurized air to be discharged, preferably into a low-pressure stream to accelerate the rate at which the air is evacuated from the applicator(s) 210.

Thus, during use, positive pressure may be applied to the applicator(s) 210 by use of the compressed gas from the capsule 212 and such pressure may be reduced by venting through the use of the valves 216. This process or cycle(s) of such application of positive pressure and reducing the same may be performed in accordance with an output or outputs from the patient as herein below described. Such cycle may continue for a predetermined amount of time, such as from the time a patient is placed into an ambulance until the patient arrives at a hospital.

The system 216 may be equipped with pressure sensors located in the feeding air hoses and close to the applicator housing(s) to regulate the pressure levels within each applicator. Pressure sensors 220 and/or 222 may also be used on the patient to determine the relative timing and the amount of increase in the diastolic pressure during the operation of the system 200. The latter information may be used to manually and/or automatically adjust the amount of positive pressure and their relative timing with respect to the heart beat in a manner as previously described.

In operation, the applicator(s) or cuff(s) 210 may be first fitted to a number of body segments of a patient such as both patient legs and thighs and buttock. The air hoses 214 may then be attached to each of the cuffs 210. EKG sensor(s) 220 may be attached to the patient chest area. The blood pressure sensor(s) 222 may be attached to the patient finger(s). The control unit 218 may initially be set so as to cause a relatively low pressure air to be provided to the applicator(s) 210. The control unit 218 may count the patient's pulse rate and based on the timing of the systolic phase as indicated by the EKG sensor(s) 220, may begin the application of pressure cycles to the limbs by proper operation of the air valves 216. The operator may monitor the output of the blood pressure sensor(s) 222 and, if desired, and may manually change the aforementioned timing of the pressure applications to the desired position within the period of cardiac diastole. The operator may then increase the amount applied pressure to the desired levels, such as to approximately 250-300 mm Hg.

In another embodiment of the present invention, the latter two steps described above may be automated using software operable to cause the control unit 218 to compare the position of the systolic pressure range and the pressure wave due to the applied positive air pressure to the limbs from the aforementioned blood pressure sensor(s) 222 outputs, and thereby determine the relative timing of each event, and considering the pulse rate adjust the timing of the positive pressure application to the limbs (for example, to position it half way in the diastolic period). The software may then cause the level of applied pressure to increase until the desired increase in the blood pressure is achieved. As is to be appreciated, the control unit software may be equipped with safeguarding capabilities, such as to detect sudden changes in the pulse rate (upon which the pressure application cycle may be interrupted) or to ensure that the resulting maximum blood pressure levels during the diastolic phase due to the operation of the machine is well below the systolic pressure.

In FIG. 15, one or more of the applicators 210 may be of the type that includes a relatively rigid housing sealed over the covered area of the skin. However, it should be noted that the present invention is not so limited and that other types of applicators, such as a bladder type of applicator may be utilized. Additionally, the applicator may not be sealed over the cover area of the patient.

Although in the present compressed gas capsule operated ECP machine was described for use in an ambulance, the present ECP is not so limited and may also be used in a number of other moving vehicles in addition to an ambulance. For example, the present ECP machine may be used in an airliner, a ship, a bus, and so forth. Additionally, the present ECP machine may be easily made available for use in a public place, a home, an office or the like in a manner similar to that of a defibrillator, so that heart attack patients could be provided with this heart muscle preserving device.

Further, a patient may be trained so as to use (or self administer) the present ECP machine. Additionally, the present ECP machine may be configured so as to be controlled at a remote central location (such as a hospital, a doctor's office, or the like) by trained personnel by way of an internet or modem connection(s) or by way of a telephone line connection or the like.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for treating a patient, said method comprising:

applying at least one housing having a shell to at least one body segment of the patient so as to at least partially surround the at least one body segment, said shell having an interior wall and an exterior wall, said interior wall containing air transfer openings permitting air flow into a space interior to the interior wall and spacer means having a number of elements sufficiently rigid to maintain said exterior wall in spaced relation with said interior wall, said elements having air transfer openings so as to permit air flow between said walls;

supplying compressed gas from a device to supply pressurized gas to the at least one housing; and controlling the flow of compressed gas from the device to supply pressurized gas to the at least one housing and operation of a pump operable to cause negative pressure relative to atmospheric pressure be applied in accordance with cardiac systole and cardiac diastolic of the patient to apply a positive relative to atmospheric pressure and a negative relative to atmospheric pressure within said space in synchronization with heart function.

2. A method for treating a patient having an acute myocardial infarction, said method comprising:

applying at least one housing having a shell to at least one body segment of the patient so as to at least partially surround the at least one body segment, said shell having an interior wall and an exterior wall, said interior wall containing air transfer openings permitting air flow into a space interior to the interior wall and spacer means having a number of elements sufficiently rigid to maintain said exterior wall in spaced relation with said interior wall, said elements having air transfer openings so as to permit air flow between said walls;

supplying compressed gas from a device to supply pressurized gas to the at least one housing; and controlling the flow of compressed gas from the device to supply pressurized gas to the at least one housing and operation of a pump operable to cause negative pressure relative to atmospheric pressure be applied in accordance with cardiac systole and cardiac diastolic of the patient to apply a positive relative to atmospheric pressure and a negative relative to atmospheric pressure within said space in synchronization with heart function.

3. The method according to claim 2, wherein the method is performed within a moving vehicle.

4. The method according to claim 3, wherein the moving vehicle is an ambulance, an airplane, or a ship.

5. An external counterpulsation cardiac assist system for treating a patient, said system comprising:

a device to supply pressurized gas;

a pump to cause negative pressure relative to atmospheric pressure be applied;

at least one housing having a shell and being adapted to at least partially surround a body segment of the patient, said shell having an interior wall and an exterior wall, said interior wall of said shell containing air transfer openings permitting air flow into a space interior to the interior wall and spacer means having a number of elements sufficiently rigid to maintain said exterior wall in spaced relation with said interior wall, said elements having air transfer openings so as to permit air flow between said walls;

means for supplying the compressed gas from the device to supply pressurized gas to the at least one housing; and means for controlling the flow of compressed gas from the device to supply pressurized gas to the at least one housing and operation of the pump in accordance with cardiac systole and cardiac diastolic of the patient to apply a positive relative to atmospheric pressure and a negative relative to atmospheric pressure within said space in synchronization with heart function.

6. An external counterpulsation cardiac assist system for treating a patient having an acute myocardial infarction, said system comprising:

a device to supply pressurized gas;

a pump to cause negative pressure relative to atmospheric pressure be applied;

at least one housing having a shell and being adapted to at least partially surround a body segment of the patient, said shell having an interior wall and an exterior wall, said interior wall of said shell containing air transfer openings permitting air flow into a space interior to the interior wall and spacer means having a number of elements sufficiently rigid to maintain said exterior wall in spaced relation with said interior wall, said elements having air transfer openings so as to permit air flow between said walls;

means for supplying the compressed gas from the device to supply pressurized gas to the at least one housing; and means for controlling the flow of compressed gas from the device to supply pressurized gas to the at least one housing and operation of the pump in accordance with cardiac systole and cardiac diastolic of the patient to apply a positive relative to atmospheric pressure and a negative relative to atmospheric pressure within said space in synchronization with heart function.

7. The external counterpulsation cardiac assist system according to claim 6, wherein the system is arranged within a moving vehicle.

8. The external counterpulsation cardiac assist system according to claim 7, wherein the moving vehicle is an ambulance, an airplane, or a ship.

* * * * *